US008321992B2

(12) United States Patent
Gauvin et al.

(10) Patent No.: US 8,321,992 B2
(45) Date of Patent: Dec. 4, 2012

(54) INTEGRATED DOCTOR BLADE HOLDERS

(75) Inventors: Royal Gauvin, Windham, ME (US); David Leeman, Worcester, MA (US)

(73) Assignee: Kadant Web Systems, Inc., Auburn, MA (US)

( * ) Notice: Subject to any disclaimer, the term of this patent is extended or adjusted under 35 U.S.C. 154(b) by 886 days.

(21) Appl. No.: 12/327,289

(22) Filed: Dec. 3, 2008

(65) Prior Publication Data

US 2009/0148208 A1 Jun. 11, 2009

Related U.S. Application Data

(60) Provisional application No. 60/992,904, filed on Dec. 6, 2007.

(51) Int. Cl.
*A46B 15/00* (2006.01)

(52) U.S. Cl. ..... 15/256.51; 15/256.5; 15/256.52

(58) Field of Classification Search ..... 15/256.5, 15/256.51, 256.52
See application file for complete search history.

(56) References Cited

U.S. PATENT DOCUMENTS

| | | | |
|---|---|---|---|
| 1,696,119 | A | 12/1928 | Heisel |
| 1,912,605 | A | 6/1933 | Vickery |
| 2,890,473 | A | 6/1959 | Scott |
| 2,948,012 | A | 8/1960 | Scott |
| 3,040,442 | A | 6/1962 | Overton |
| 3,291,541 | A | 12/1966 | Dellinger |
| 3,593,663 | A | 7/1971 | Vischulis |
| 3,645,844 | A | 2/1972 | Grenier |
| 3,748,686 | A | 7/1973 | Winterburn et al. |
| 3,778,861 | A | 12/1973 | Goodnow |
| 3,780,670 | A | 12/1973 | Abler et al. |
| 3,803,665 | A | 4/1974 | Winterburn et al. |
| 3,854,162 | A | 12/1974 | Russell |
| 3,866,266 | A | 2/1975 | Dunlap |
| 4,241,691 | A | 12/1980 | Hopfe et al. |
| 4,367,120 | A | 1/1983 | Hendrikz |
| 4,459,176 | A | 7/1984 | Goodnow |
| 4,542,554 | A | 9/1985 | Wallerstein |
| 4,665,859 | A | 5/1987 | Dunlap et al. |
| 4,789,432 | A | 12/1988 | Goodnow et al. |
| 4,821,672 | A | 4/1989 | Bruno |
| 4,906,335 | A | 3/1990 | Goodnow et al. |

(Continued)

FOREIGN PATENT DOCUMENTS

| | | | |
|---|---|---|---|
| DE | 1055351 | B | 4/1959 |

(Continued)

*Primary Examiner* — Lee D Wilson
*Assistant Examiner* — Shantese McDonald
(74) *Attorney, Agent, or Firm* — Cesmer Updegrove LLP

(57) ABSTRACT

A doctor blade holder is disclosed that includes first and second members as well as position adjustment means. The first member includes a plurality of first member mounting structures that are integrally formed with the first member and are mutually spaced apart from one another along an elongated direction that is parallel with an elongated edge of a doctor blade. The second member is coupled to the first member, at least in part, by a plurality of second member mounting structures that are mutually spaced apart from one another along the elongated direction that is parallel with the elongated edge of the doctor blade. The position adjustment means is for adjusting the relative positions of the first member and the second member while the first member is coupled to the second member, at least in part, by the plurality of first member mounting structures and the plurality of second member mounting structures.

22 Claims, 10 Drawing Sheets

U.S. PATENT DOCUMENTS

| | | | | |
|---|---|---|---|---|
| 5,070,783 | A | 12/1991 | Ireton | |
| 5,279,710 | A | 1/1994 | Aikawa | |
| 5,284,516 | A | 2/1994 | Sieberth | |
| 5,389,151 | A | 2/1995 | Fort | |
| 5,406,887 | A | 4/1995 | Hertel et al. | |
| 5,408,720 | A | 4/1995 | Miles | |
| 5,980,692 | A | 11/1999 | Goodnow et al. | |
| 6,139,638 | A | 10/2000 | Dubois et al. | |
| 6,202,252 | B1 | 3/2001 | Harrisson | |
| 6,276,835 | B1 | 8/2001 | Reid et al. | |
| 6,312,563 | B1 | 11/2001 | Goodnow et al. | |
| 6,328,853 | B1 | 12/2001 | Goodnow et al. | |
| 6,447,646 | B1 | 9/2002 | Hassinen et al. | |
| 6,491,754 | B1 | 12/2002 | Graf et al. | |
| 6,524,444 | B2 * | 2/2003 | Brauns et al. | 162/281 |
| 6,786,999 | B2 | 9/2004 | Goodnow et al. | |
| 6,942,734 | B2 | 9/2005 | Rata et al. | |
| 2006/0180291 | A1 * | 8/2006 | Rata | 162/281 |

FOREIGN PATENT DOCUMENTS

| | | | |
|---|---|---|---|
| DE | 1147105 | B | 4/1963 |
| DE | 10225399 | A1 | 12/2002 |
| EP | 0294992 | A2 | 12/1988 |
| EP | 0442165 | A2 | 8/1991 |
| EP | 0485597 | A1 | 5/1992 |
| EP | 1123751 | A1 | 8/2001 |
| EP | 1186703 | A | 3/2002 |
| EP | 1734181 | A | 12/2006 |
| FR | 2690719 | A1 | 11/1993 |
| FR | 2750465 | A1 | 1/1998 |
| GB | 742882 | A | 1/1956 |
| GB | 886264 | A | 1/1962 |
| GB | 990670 | A | 4/1965 |
| JP | 11170478 | A | 6/1999 |
| WO | 99/32717 | A | 7/1999 |
| WO | WO9932717 | | 7/1999 |
| WO | WO9964674 | A1 | 12/1999 |
| WO | WO0044981 | A1 | 8/2000 |
| WO | WO2004042143 | A1 | 5/2004 |
| WO | WO2004067839 | A1 | 8/2004 |
| WO | 2008/022096 | A | 2/2008 |

* cited by examiner

INTEGRATED DOCTOR BLADE HOLDERS

PRIORITY

This application claims priority to U.S. Provisional Patent Application Ser. No. 60/992,904 filed Dec. 6, 2007.

BACKGROUND OF THE INVENTION

1. Field of the Invention

This invention relates to doctor blade holders, and is concerned in particular with an improved design that simplifies holder manufacturing, assembly, installation and maintenance.

2. Description of the Prior Art

Many roll cleaning and sheet shedding applications on papermaking machines and other web handling applications involve blade support devices commonly referred to as doctor blade holders for supporting blades such as doctor blades, creping blades and scraping blades etc.

Certain prior art doctor blade holders include a top plate (to which a doctor blade is joined), a bottom plate, and a mounting and adjustment assembly between the top and bottom plates. The bottom plate is mounted on a doctorback, which is a heavy-duty beam that spans the paper machine width. The rear portion of a doctor blade is received into the doctor blade holder that supports the blade in a pre-determined position relative to a surface to be cleaned. The doctor blade holder works in concert with the doctor blade to apply the working edge of the doctor blade, found on the blade's front portion, to an adjacent moving surface such as a roll.

FIG. 1 for example, shows a prior art doctoring apparatus 10 that is adjacent to the surface of a roll 12. The roll rotates about an axis $A_1$, and the doctoring apparatus includes a doctorback 14 that is rotatable about an axis $A_2$, which is parallel to the axis $A_1$. A doctor blade holder 16 is shown supported on a beam 18, which forms part of the doctorback. The doctor blade holder 16 includes has top plate 20 and a bottom plate 22 that are joined by a mounting and adjustment assembly. A doctor blade 24 is received within a lower jaw opening 26 on the underside of the top plate 20.

With further reference to FIG. 2, the mounting and adjustment assembly includes a plurality of top plate brackets 28 and a plurality of bottom plate brackets 30 that are mutually joined together by a pivot rod 32. The mounting and adjustment assembly also includes a loading tube 34 and an unloading tube 36 that may each be alternately increased or decreased in size by adjusting an amount of fluid within each tube to effect a limited rotation of the top plate with respect to the axis $A_3$ that is the central axis of the pivot rod 32. This limited rotation permits the doctor blade 24 to engage the roll 12 to effect doctoring, or to disengage the roll 12. A piston/cylinder unit 38 acts via a crank arm 40 to rotate the doctorback 14 about axis $A_2$ in order to provide gross positioning of the doctor blade 24 near and away from the roll surface.

Doctor blade holders are typically assemblages of several discrete components, many of which (such as the brackets 28 and 30) are duplicated within the assembly dozens or scores of times, and must be riveted or otherwise fastened to the plates 20 and 22 respectively. This multiplicity of components has allowed holder manufacturers to custom-build holders to match the custom-built paper machines. These multiple repeating components, however, require substantial assembly time, which increases holder cost and opportunities for assembly errors.

Other prior art doctor blade holders, such as disclosed in U.S. Pat. No. 6,447,646, include an extruded or pultruded holder frame 40 that is pivotally mounted to an extruded or pultruded bearer 42 via a jointed bearing assembly 44 as shown in FIG. 3. The jointed bearing assembly 44 includes a joint sleeve 46 (e.g., in holder frame 40) that couples with a unified axle 48 (e.g., in the bearer 42). A doctor blade 50 is coupled to a blade holder 52, which is attached to the holder frame 40. Loading devices 54 and 56 apply positive and negative loading forces to the doctor blade 50 with respect to the roll 58. Separating the holder frame 40 from the bearer 42, however, requires sliding the holder frame 40 and the bearer 42 with respect to one another along the full elongated dimension of the doctoring apparatus, which may be a several or more meters in width. This may not only be awkward and/or impractical, but it may further require that the doctoring apparatus be moved to a more spacious location. U.S. Patent Applications Publication Nos. 2006/0180291 and 2006/0289141, as well as U.S. Pat. No. 6,942,734 also disclose doctor blade holder systems that include integrally formed mounting elements that extend along the elongated dimension of the doctor blade.

Further prior art blade holder systems, such as for example disclosed in U.S. Patent Application Publication No. 2006/0054293, include a base plate 60 and a cover plate 62 having a finger device 64 that receives a scrapping blade 66 as shown in FIG. 4. The base plate 60 and cover plate 62 are pivotally coupled together by a bearing tube 68 mounted on the based plate 60, which is received within a square tube 70 mounted to the underside of the cover plate 62. The square tube 70 is disclosed to be installed in segments in a direction perpendicular to the plane of the drawing in order to impair the resilience of the cover plate 62 as little as possible. The rotational position of the cover plate 62 with respect to the base plate 60 is adjustable by the inflation/deflation of an air pressure hose 72 in cooperation with a spring 74. Separating the cover plate 62 from the base plate 60, however, requires sliding the cover plate 62 and the base plate 60 with respect to one another along the full elongated dimension of the doctoring apparatus, which may be a several or more meters in width.

An objective of the present invention is to provide an improved holder design that greatly reduces the number of components and the assembly time, while providing means for quick and reliable in-situ disassembly for maintenance and repair of new and existing systems.

SUMMARY

The invention provides a doctor blade holder that includes first and second members as well as position adjustment means. In accordance with an embodiment, the first member includes a plurality of first member mounting structures that are integrally formed with the first member and are mutually spaced apart from one another along an elongated direction that is parallel with an elongated edge of a doctor blade. The second member is coupled to the first member, at least in part, by a plurality of second member mounting structures that are mutually spaced apart from one another along the elongated direction that is parallel with the elongated edge of the doctor blade. The position adjustment means is for adjusting the relative positions of the first member and the second member while the first member is coupled to the second member, at least in part, by the plurality of first member mounting structures and the plurality of second member mounting structures.

In accordance with another embodiment, the first member includes an elongated edge that is adapted for receiving a doctor blade, and a plurality of first member mounting structures that are integrally formed with the first member and are mutually spaced apart from one another along an elongated direction that is parallel with the elongated edge. The second member is coupled to the first member, at least in part, by a plurality of second member mounting structures that are mutually spaced apart from one another along the elongated direction that is parallel with the elongated edge of the first member. The second member is also coupled to a doctorback. The position adjustment means is for adjusting the relative positions of the first member and the second member while the first member is coupled to the second member, at least in part, by the plurality of first member mounting structures and the plurality of second member mounting structures.

In accordance with a further embodiment, the first member includes an elongated edge that is adapted for receiving a doctor blade, and a plurality of first member mounting structures that are integrally formed with the first member and are mutually spaced apart from one another along an elongated direction that is parallel with the elongated edge. The second member is coupled to the first member, at least in part, by a plurality of second member mounting structures that are mutually spaced apart from one another along the elongated direction that is parallel with the elongated edge of the first member. The position adjustment means is for adjusting the relative positions of the first member and the second member while the first member is coupled to the second member, at least in part, by the plurality of first member mounting structures and the plurality of second member mounting structures. The position adjustment means includes two inflatable tubes that are supported by the second member on either side of the plurality of second member mounting structures.

BRIEF DESCRIPTION OF THE DRAWINGS

The following description may be further understood with reference to the accompanying drawings in which.

The drawings are shown for illustrative purposes.

DETAILED DESCRIPTION

In view of the foregoing disadvantages inherent in the known types of tube loaded holders now present in prior art, the present invention provides a new holder having the advantages of reduced component counts, assembly and installation time while providing means for quick in-situ disassembly for maintenance and repair.

A primary object of the present invention is to provide a lightweight, easily constructed doctor blade holder. Another object is to provide a means for quick in-situ disassembly for maintenance and repair. Another object is to provide additional cross-machine flexibility by incorporating within the holder assembly a composite top plate having a substantial portion of reinforcing fibers therein oriented in the machine direction.

Another object is to provide for the use of a two-tube blade loading and unloading system familiar to paper machine operators and easily integrated with pre-existing equipment.

Figure 1:
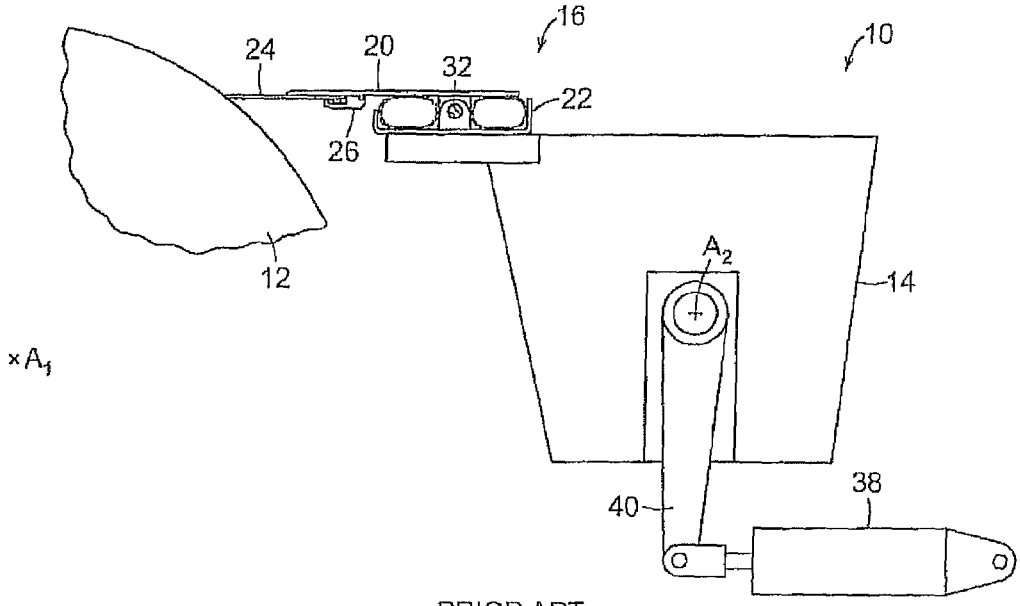
PRIOR ART FIG. 1
FIG. 1 shows an illustrative diagrammatic side view of a prior art doctor blade holder attached to a doctorback.
Figure 2:
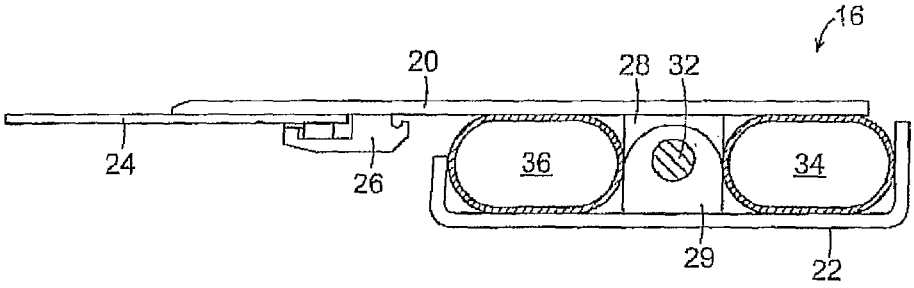
PRIOR ART FIG. 2
FIG. 2 shows an illustrative diagrammatic enlarged side view of the doctor blade holder of FIG. 1.
Figure 3:
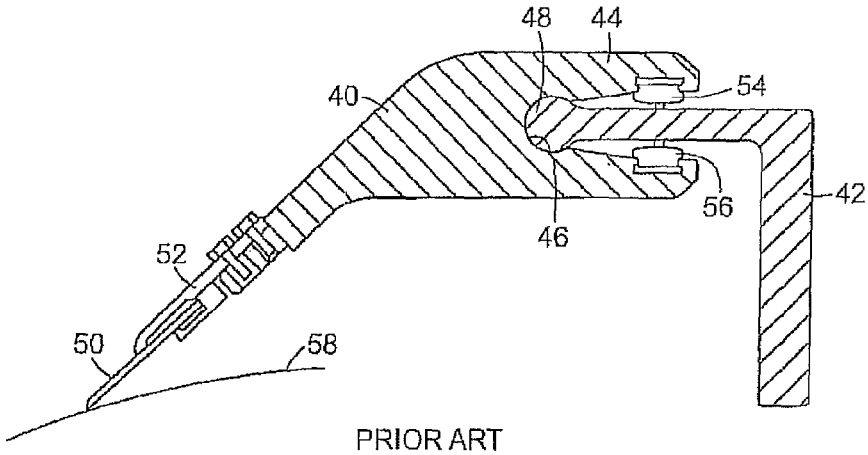
PRIOR ART FIG. 3
FIGS. 3 and 4 show illustrative diagrammatic side views of further prior art doctor blade holders.
Figure 4:
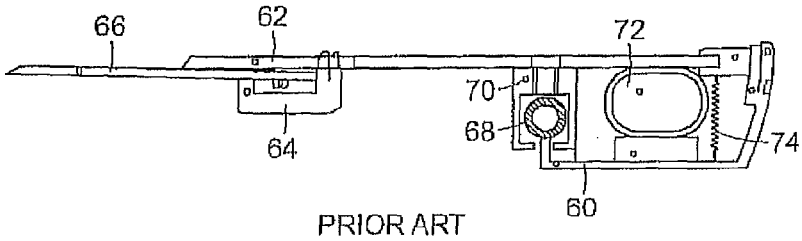
PRIOR ART FIG. 4
Figure 5:
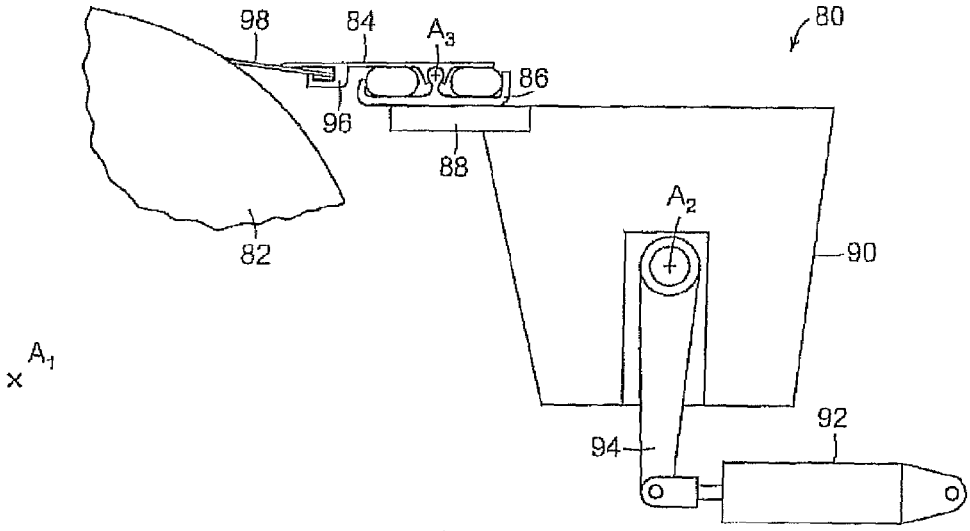
FIG. 5 shows an illustrative diagrammatic side view of a doctor blade holder in accordance with an embodiment of the invention attached to a doctorback.

With reference to FIG. 5, a doctoring apparatus 80 in accordance with an embodiment of the invention is provided for use with a moving surface such as an outer surface of a roll 82. The doctor blade holder of the doctoring apparatus 80 includes a first member such as a top plate 84, and a second member such as a tube tray 86. The tube tray 88 is secured to a beam 88 of a doctorback 90 that is rotatable about axis $A_2$ using the piston/cylinder unit 92 and crank arm 94. The top plate 84 includes an extended lower jaw portion 96 for receiving a doctor blade 98. The rear edge of the doctor blade 98 is captured between the planar top plate 84 and the extended lower jaw portion 96 of the integrated top plate 84, and the forward edge of the doctor blade 98 is applied to the surface of the roll 82 to effect doctoring.

Figure 6:
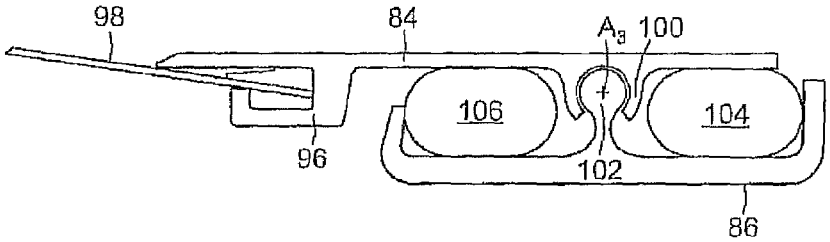
FIG. 6 is an illustrative diagrammatic enlarged side view of the doctor blade holder of FIG. 5.

As further shown in FIG. 6, the top plate 84 also includes integrally formed mounting structures 100, and the tube tray 86 includes integrally formed mounting structures 102. The mounting structures 100 and 102 are shaped and configured to mate when engaged along a direction that is parallel the working edge of the doctor blade 98. In particular, and with further reference to FIGS. 7 and 8, the integral mounting structures 100 are spaced apart by a distance $d_1$ that is long enough to accommodate an associated mounting structure 102 having an elongated dimension $d_2$ of the tube tray 86. The integral mounting structures 102 are also spaced apart by a distance that is long enough to accommodate an associated mounting structure 100 of the top plate 84. When the mounting structures 100 and 102 are aligned with one another in an interleaved fashion, they may be moved relative one another (in a direction that is parallel an elongated direction of the working edge of the doctor blade) to secure the top plate to the tube tray. The top plate and tube tray may later be separated from one another by simply moving one or both of the top plate and tube tray relative one another in the reverse direction. The doctor blade holder of FIGS. 5-8 also includes inflatable loading and unloading tubes 104 and 106 for providing limited pivotal movement of the top plate and bottom tray with respect to one another about an axis $A_3$.

Figure 7:
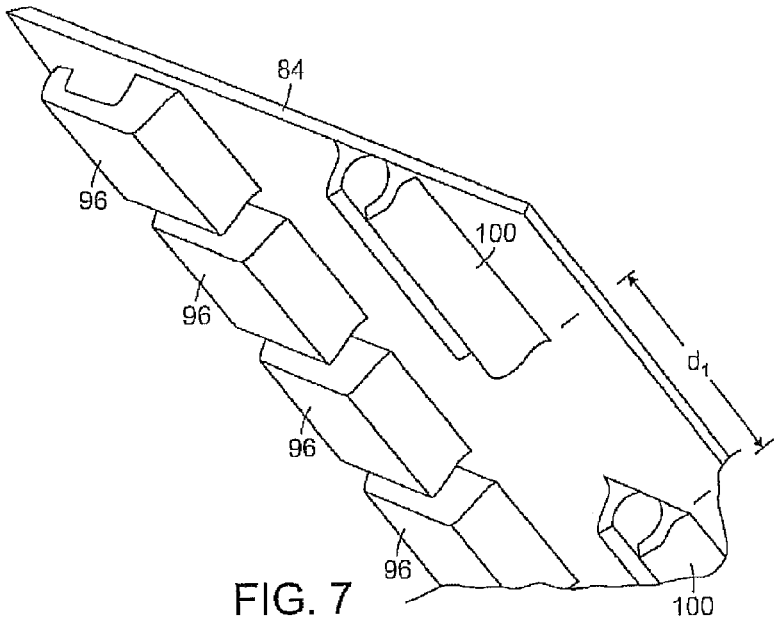
FIG. 7 is an illustrative diagrammatic bottom isometric view of the integrated top plate of FIG. 6.
Figure 8:
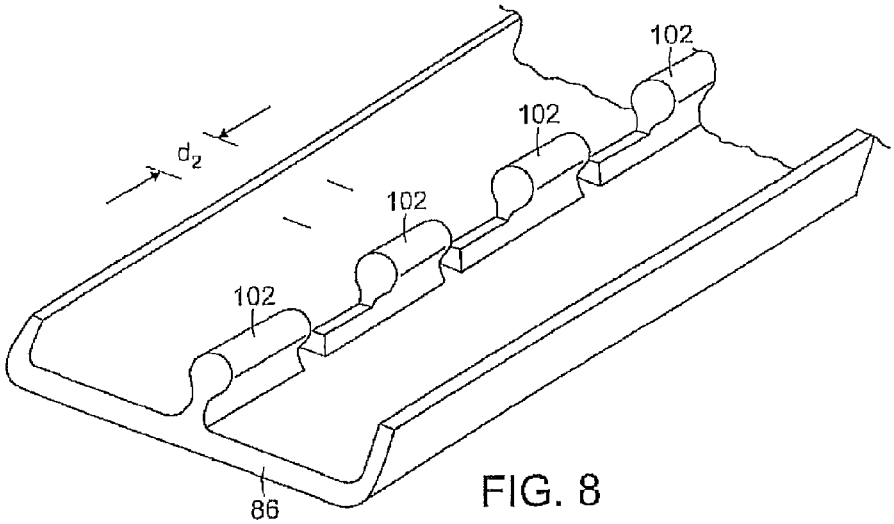
FIG. 8 is an illustrative diagrammatic top isometric view of the tube tray of FIG. 6.

The top plate 84 may be formed of a metal, alloy, polymeric material, fiberglass reinforced polymeric material, or composites thereof, and may be extruded or pultruded in a cross-sectional shape as shown from the side view in FIG. 6 including a continuous mounting structure and a continuous extended lower jaw portion. Sections of the continuous mounting structure are then removed (e.g., cut by a saw or laser) to provide the plurality of mutually spaced mounting structures 100 that are integral with the top plate 84. The voids between the structures 100 may be varied in depth and width to provide a range of axial flexibility. Similarly, sections of the continuous extended lower jaw portion may be removed (e.g., cut by a saw or laser) to provide the plurality of mutually spaced extended lower jaw portions 96 as shown in FIG. 7. The voids between the jaw portions 96 may also be varied in depth and width to provide a range of axial flexibility.

The present invention uniquely incorporates a slide and lock feature whereby the first member (e.g., upper portion) of the holder may be separated from the second member (e.g., lower portion) of the holder by an axial sliding motion of, for example, approximately three inches. This feature allows in-situ holder disassembly, without need to extract the full-length top plate or tray component, or need to move the entire doctoring assembly.

The new holder design significantly reduces cost and assembly errors by reduction of the number of unique parts and the total part count, and by reducing assembly time.

Figure 9:
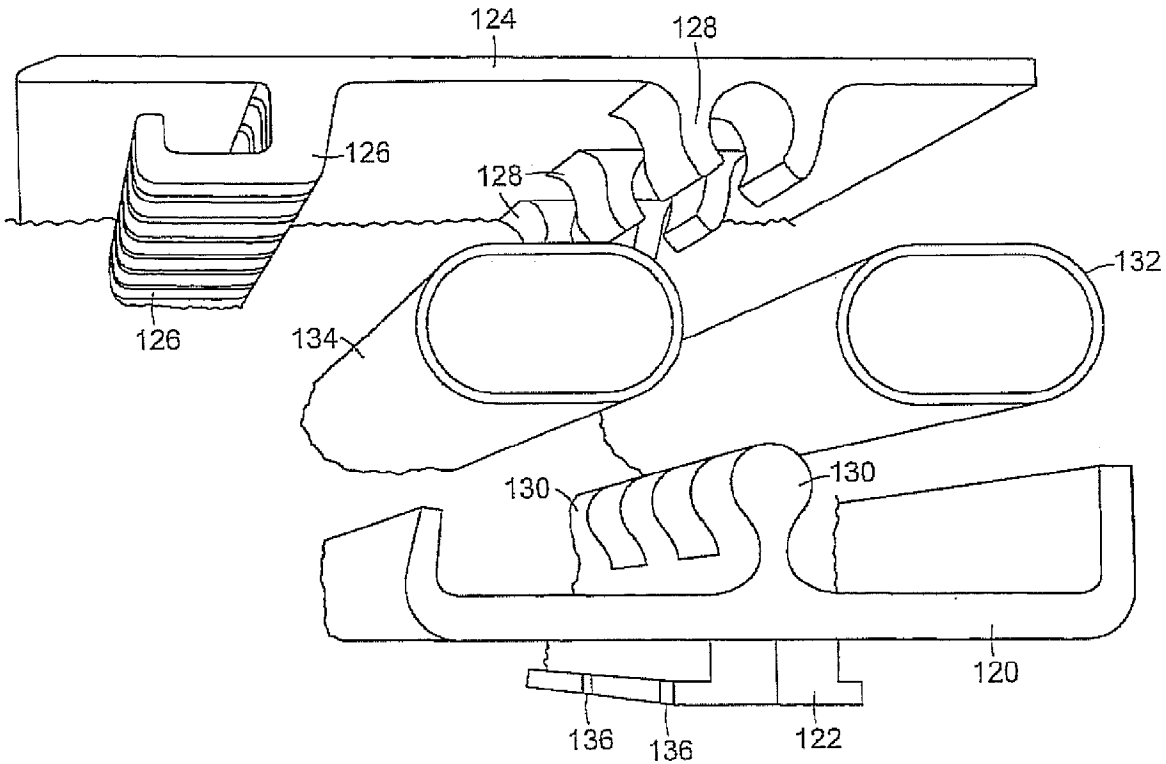
FIG. 9 shows an illustrative diagrammatic isometric view of a doctor blade holder in accordance with a further embodiment of the invention.
Figure 10:
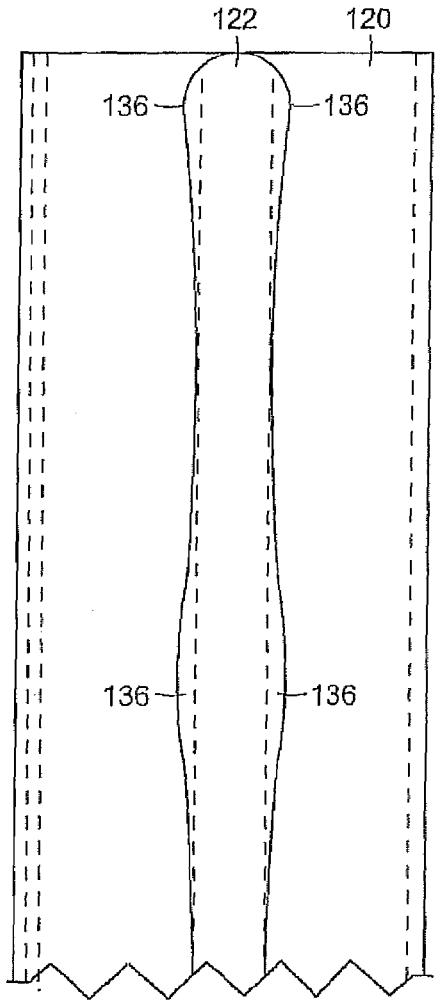
FIG. 10 shows an illustrative diagrammatic bottom view of the tube tray of FIG. 9.

FIG. 9 shows a doctor blade holder in accordance with another embodiment of the invention in which a tube tray 120 includes an integrally formed beam coupling structure 122 (that is generally T-shaped) for engaging a mating structure on a beam of a doctorback. The doctor blade holder further includes another member, a top plate 124, includes integrally formed extended lower jaw portions 126 for receiving a doctor blade, as well as integrally formed mutually spaced (female or socket-shaped) mounting structures 128 that are designed to engage in a slide and lock arrangement (similar to the embodiment of FIGS. 3-8) with mutually spaced (male or ball-shaped) mounting structures 130 that are integrally formed on the tube tray 120 as discussed above. Loading and unloading tubes 132, 134 are also provided to permit adjustment of the rotational position of the two members 120, 124 with respect to one another. FIG. 10 shows a bottom view of the tube tray 120 of FIG. 9 in which the bottom edge of the inverted T-shaped structure includes extended regions 136 that provide a low frictional contact fit between the structure 122 and a mating structure of a beam (i.e., lower than the frictional contact would be if the entire elongated lengths of the two mating structures contacted one another). The mating structure of the beam may include a recess opening that is generally T-shaped in cross section that is configured to receive the structure 122 of the tube tray. The bottom tray 120 may include the structure 122 when it is extruded or pultruded, and a saw or laser may be used to remove portions of the structure such that the extended regions 136 remain.

Figure 11:
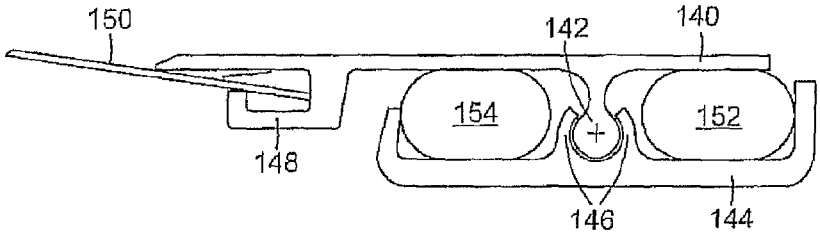
FIGS. 11-13 show illustrative diagrammatic side views of doctor blade holders in accordance with further embodiments of the invention.

FIG. 11 shows a doctor blade holder in accordance with a further embodiment of the invention in which the top plate 140 includes male (or ball-shaped) mounting structures 142 that are integral with the top plate 140, and the tube tray 144 includes female (or socket-shaped) mounting structures 146 that are integral with the tube tray 144. The top tray 140 also includes integrally formed lower jaw portions 148 for receiving a doctor blade 150. Loading and unloading tubes 152, 154 are provided on the tube tray 144 for adjusting the relative position of the top plate 140 and the tube tray 144.

Figure 12:
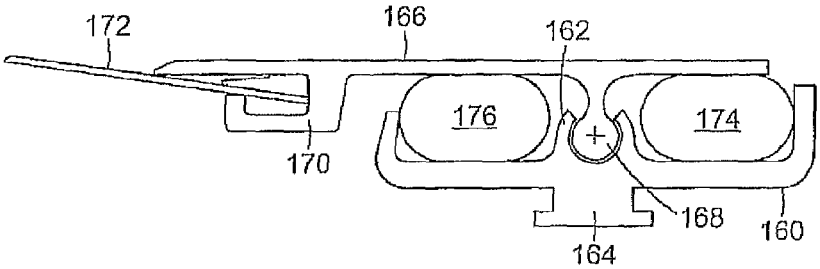

FIG. 12 shows a doctor blade holder in accordance with a further embodiment of the invention in which the tube tray 160 includes female (or socket-shaped) mounting structures 162 that are integral with the tube tray 160 as well as integrally formed beam engaging structure 164 that is generally T-shaped in cross-section for engaging a mating structure on a beam as discussed above with reference to FIGS. 9 and 10. The top plate 166 includes male (or ball-shaped) mounting structures 168 that are integral with the top plate 160. The top tray 160 also includes integrally formed lower jaw portions 170 for receiving a doctor blade 172. Loading and unloading tubes 174, 176 are provided on the tube tray 160 for adjusting the relative position of the top plate 166 and the tube tray 160.

Figure 13:
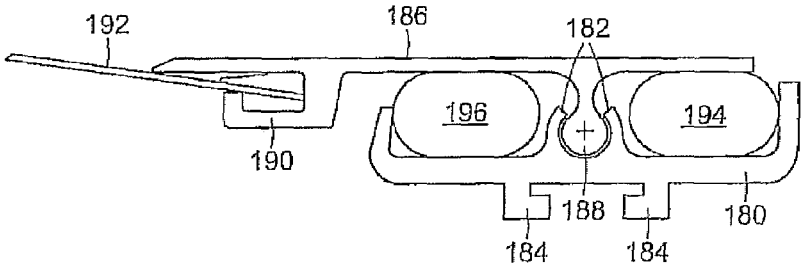

FIG. 13 shows a doctor blade holder in accordance with a further embodiment of the invention in which the tube tray 180 includes female (or socket-shaped) mounting structures 182 that are integral with the tube tray 180 as well as integrally formed beam engaging structure 184 that provides a recess that is generally T-shaped in cross-section for engaging a (generally T-shaped) mating structure on a beam. The top plate 186 includes male (or ball-shaped) mounting structures 188 that are integral with the top plate 180. The top tray 180 also includes integrally formed lower jaw portions 190 for receiving a doctor blade 192. Loading and unloading tubes 194, 196 are provided on the tube tray 180 for adjusting the relative position of the top plate 186 and the tube tray 180.

Figure 14A:
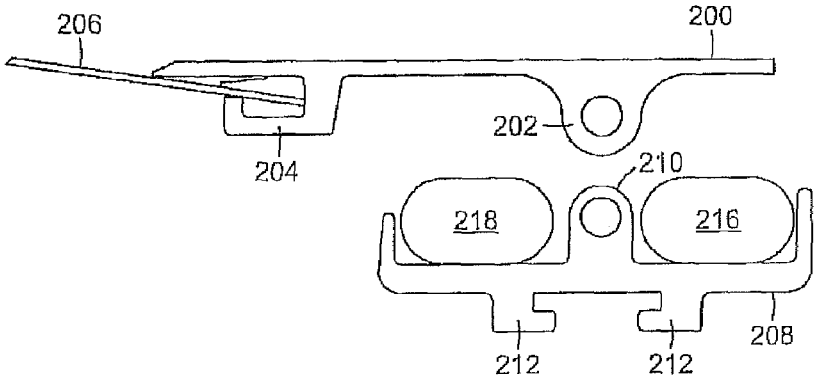
FIGS. 14A, 14B and 14C show illustrative diagrammatic views of a further embodiment of a doctor blade holder of the invention employing a pivot rod.
Figure 14B:
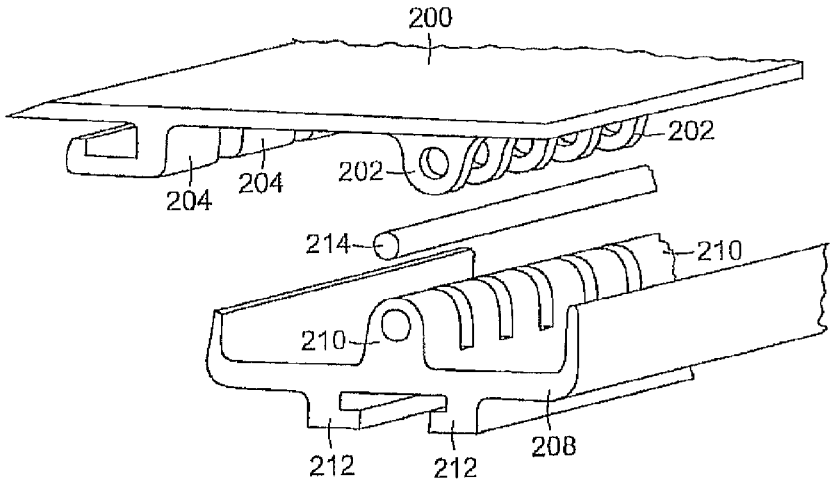
Figure 14C:
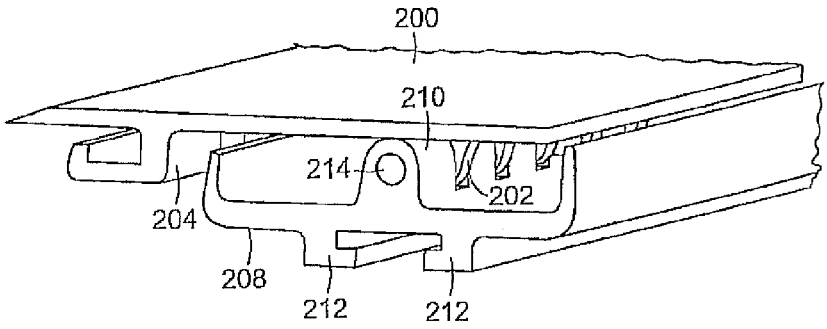

FIGS. 14A, 14B and 14C show a doctor blade holder in accordance with a further embodiment of the invention in which a first member, a top plate 200, includes integrally formed closed annular mounting structures 202 as well as integrally formed lower jaw portions 204 for receiving a doctor blade 206. A second member, a tube tray 208, includes integrally formed closed annular mounting structures 210 as well as an integrally formed beam engaging structure 212 that provides a recess that is generally T-shaped in cross-section for engaging a (generally T-shaped) mating structure on a beam. The doctor blade holder also includes a pivot rod 214 that is inserted through each of the closed annular mounting structures 202, 210 when the mounting structures are aligned with one another. The pivot rod may be sufficiently flexible that removing the pivot rod is not difficult.

Loading and unloading tubes 216, 218 are provided on the tube tray 180 for adjusting the relative position of the top plate 186 and the tube tray 180. The integral formation of the mounting structures with the associated top plate and/or tube tray, may provide sufficient reduction in assembly cost and time, as well as reliable in-situ disassembly and repair, even of existing multi-component pivotal engagement systems for certain applications.

Figure 15A:
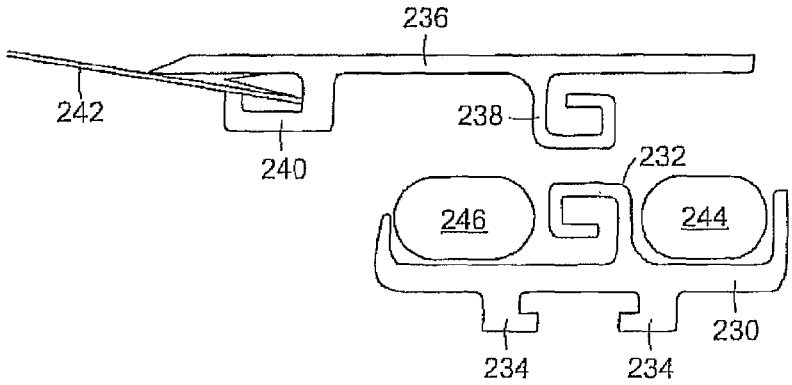
FIGS. 15A and 15B show illustrative diagrammatic views of a further embodiment of a doctor blade holder employing interlocking structures each having a spiral cross-section.
Figure 15B:
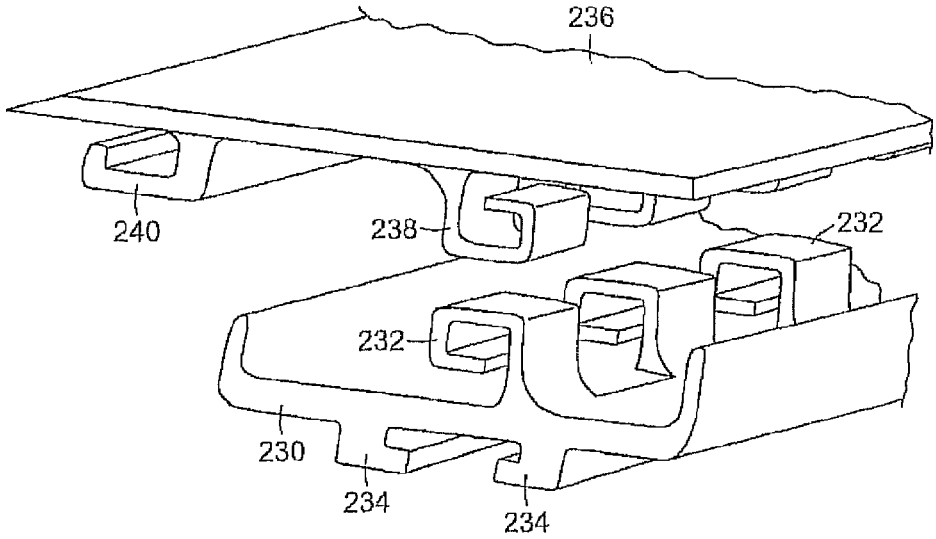

FIGS. 15A and 15B show a doctor blade holder in accordance with a further embodiment of the invention in which the tube tray 230 includes generally spiral cross-sectional shaped mounting structures 232 that are integral with the tube tray 230 as well as integrally formed beam engaging structure 234 that provides a recess that is generally T-shaped in cross-section for engaging a (generally T-shaped) mating structure on a beam. The top plate 236 includes generally spiral cross-sectional shaped mounting structures 238 that are integral with the top plate 236. The top plate 236 also includes integrally formed continuous lower jaw portion 240 for receiving a doctor blade 242. Loading and unloading tubes 244, 246 are provided on the tube tray 230 for adjusting the relative position of the top plate 236 and the tube tray 230.

The integrated top plate and associated mounting structure, and the integrated tube tray and associated mounting structure of each of the above disclosed embodiments, may be formed from metal alloys, such as 300 series stainless steel, or 6000 series aluminum, the latter preferred, or from plastic materials such as epoxy or vinyl ester, with vinyl ester preferred. The aluminum is preferably treated with protective coatings well known to those skilled in the art. The plastic materials preferably incorporate reinforcing agents well known to those skilled in the art.

The embodiments of the present invention have the advantage of simplified construction while maintaining strength and corrosion resistance appropriate to the many different paper-making environments. The simplified construction allows savings in assembly time, and where aluminum or composites are used, savings in materials as well. The short differential axial movement that unlocks the integrated top plate from the tube tray allows quick assembly and disassembly of the holder without a first removal of a full length engagement mechanism such as the pivot rod found in prior art holders.

Those skilled in the art will appreciate that numerous modifications and variations may be made to the above disclosed embodiments without departing from the spirit and scope of the invention.

What is claimed is:

1. A doctor blade holder comprising:

a first member including a plurality of first member mounting structures that are integrally formed with the first member and are mutually spaced apart from one another along an elongated direction that is parallel with an elongated edge of a doctor blade;

a second member that is coupled to the first member, at least in part, by a plurality of second member mounting structures that are mutually spaced apart from one another along the elongated direction that is parallel with the elongated edge of the doctor blade; and position adjustment means for adjusting the relative positions of the first member and the second member while the first member is coupled to the second member, at least in part, by the plurality of first member mounting structures and the plurality of second member mounting structures.

2. The doctor blade holder as claimed in claim 1, wherein said first member includes an elongated receiving structure for receiving a doctor blade, and said second member is coupled to a doctor back.

3. The doctor blade holder of claim 2, wherein said second member further includes an integrally formed beam coupling structure for engaging a beam of the doctorback.

4. The doctor blade holder of claim 3, wherein the beam coupling structure includes at least one edge along the elongated direction that includes a plurality of extended regions for securing a low frictional contact fit with second member coupling structure on the beam of the doctorback.

5. The doctor blade holder of claim 3, wherein the beam coupling structure that is integrally formed with the second member is generally T-shaped.

6. The doctor blade holder of claim 3, wherein the beam of a doctorback includes second member coupling structure that is generally T-shaped for engaging the beam coupling structure of the second member.

7. The doctor blade holder of claim 1, wherein said plurality of first member mounting structures engages the plurality of second member mounting structures along the elongated direction that is parallel with the elongated edge of the doctor blade.

8. The doctor blade holder of claim 7, wherein said plurality of first member mounting structures are generally spiral cross-sectional shaped, and said plurality of second member mounting structures are also generally spiral cross-sectional shaped.

9. The doctor blade holder of claim 1, wherein said second member is coupled to the first member by a pivot rod that extends through said first member mounting structures and said second member mounting structures.

10. The doctor blade holder of claim 1, wherein said second member mounting structures are integrally formed with the second member.

11. The doctor blade holder of claim 1, wherein said first member mounting structures are mutually spaced apart from one another by first spacing distance that is at least as large as an elongated dimension of the second member mounting structures in the elongated direction.

12. The doctor blade holder of claim 1, wherein said position adjustment means includes an inflatable tube on either side of the coupled first member mounting structures and the second member mounting structures.

13. A doctor blade holder comprising:

a first member including an elongated edge that is adapted for receiving a doctor blade, and a plurality of first member mounting structures that are integrally formed with the first member and are mutually spaced apart from one another along an elongated direction that is parallel with the elongated edge;

a second member that is coupled to the first member, at least in part, by a plurality of second member mounting structures that are mutually spaced apart from one another along the elongated direction that is parallel with the elongated edge of the first member, said second member also being coupled to a doctorback; and position adjustment means for adjusting the relative positions of the first member and the second member while the first member is coupled to the second member, at least in part, by the plurality of first member mounting structures and the plurality of second member mounting structures.

14. The doctor blade holder of claim 13, wherein said plurality of first member mounting structures engages the plurality of second member mounting structures along the elongated direction that is parallel with the elongated edge of the first member.

15. The doctor blade holder of claim 13, wherein said second member mounting structures are integrally formed with the second member.

16. The doctor blade holder of claim 13, wherein said first member mounting structures are mutually spaced apart from one another by first spacing distance that is at least as large as an elongated dimension of the second member mounting structures in the elongated direction.

17. The doctor blade holder of claim 13, wherein said second member further includes an integrally formed beam coupling structure for engaging a beam of the doctorback.

18. The doctor blade holder of claim 17, wherein said doctorback is position adjustable with respect to a moving surface.

19. A doctor blade holder comprising:

a first member including an elongated edge that is adapted for receiving a doctor blade, and a plurality of first member mounting structures that are integrally formed with the first member and are mutually spaced apart from one another along an elongated direction that is parallel with the elongated edge;

a second member that is coupled to the first member, at least in part, by a plurality of second member mounting structures that are mutually spaced apart from one another along the elongated direction that is parallel with the elongated edge of the first member; and position adjustment means for adjusting the relative positions of the first member and the second member while the first member is coupled to the second member, at least in part, by the plurality of first member mounting structures and the plurality of second member mounting structures, said position adjustment means including two inflatable tubes that are in contact with the second member on either side of the plurality of second member mounting structures.

20. The doctor blade holder of claim 19, wherein said first member mounting structures are mutually spaced apart from one another by first spacing distance that is at least as large as an elongated dimension of the second member mounting structures in the elongated direction.

21. The doctor blade holder of claim 19, wherein said second member further includes an integrally formed beam coupling structure for engaging a beam of a doctorback.

22. The doctor blade holder of claim 19, wherein said plurality of first member mounting structures engages the plurality of second member mounting structures along the elongated direction that is parallel with the elongated edge of the first member.

* * * * *